US005420775A

United States Patent [19]

Kusmer

[11] Patent Number: 5,420,775

[45] Date of Patent: May 30, 1995

[54] SPRAY SHIELD DIE CUT FROM FIXTURE CARTON FLAP

[75] Inventor: Raymond J. Kusmer, Yorba Linda, Calif.

[73] Assignee: Thomas Industries, Inc., Los Angeles, Calif.

[21] Appl. No.: 238,967

[22] Filed: Mar. 5, 1994

Related U.S. Application Data

[63] Continuation of Ser. No. 5,485, Jan. 15, 1993, abandoned.

[51] Int. Cl.[6] ..... F21V 15/00; B65D 79/00

[52] U.S. Cl. ..... 362/376; 150/154; 229/103; 206/216; 118/505

[58] Field of Search ..... 150/154; 229/103; 206/216, 457, 831; 427/282, 421; 118/301, 504, 505; 362/376

[56] References Cited

U.S. PATENT DOCUMENTS

| | | | |
|---|---|---|---|
| 2,844,245 | 7/1958 | Grubee et al. | 206/216 |
| 3,037,682 | 6/1962 | Daubert | 206/216 |
| 3,100,642 | 8/1963 | Goldstien | 229/103 |
| 3,833,113 | 9/1974 | Osier | 229/103 |
| 4,792,191 | 12/1988 | Farmer | 118/505 |
| 5,014,853 | 5/1991 | Crocket | 229/103 |
| 5,094,359 | 3/1992 | DeMars et al. | 229/103 |
| 5,103,762 | 4/1992 | Long et al. | 118/504 |
| 5,110,038 | 5/1992 | Pantisano et al. | 229/103 |
| 5,186,319 | 2/1993 | Ting | 206/457 |

*Primary Examiner*—Richard A. Bertsch
*Assistant Examiner*—Roland G. McAndrews, Jr.
*Attorney, Agent, or Firm*—Hill, Steadman & Simpson

[57] ABSTRACT

A spray shield for temporarily covering an open face of a fixture, particularly a canister light fixture. The spray shield is conveniently outlined on and removable from a panel of cardboard shelf packaging of the canister light. The spray shield provides a disk-shaped portion surrounded by radially extending tabs which can be bent off from to the disk-shaped portion to form a resilient shallow pan which is grippingly held within an inside surface of the canister light. The spray shield as a flat panel can be easily removed from a panel of the packaging which provides a weakened line around an outer circumference of the spray shield.

25 Claims, 1 Drawing Sheet

SPRAY SHIELD DIE CUT FROM FIXTURE CARTON FLAP

This is a continuation of application Ser. No. 08/005,485, filed Jan. 15, 1993, now abandoned.

BACKGROUND OF THE INVENTION

The invention relates to a temporary spray shield for covering an open side of fixtures during plaster or paint spraying and particularly to a spray shield for recessed down lighting fixtures. The invention particularly relates to canister-type or cylindrical recessed down lights.

In construction or remodeling, it is known to apply plaster or paint or other coating materials by spraying onto walls or ceilings. If recessed lighting is pre-installed within the wall or ceiling to be sprayed, the spray or overspray can enter and foul an inside surface of the recessed lighting housing, or the light bulb held within, through the open end of the fixture facing the living area. To prevent spray entering the fixtures such as canisters, or housings, the recessed lighting must be masked, or removed, or initially not installed until after for the spraying operation.

SUMMARY OF THE INVENTION

The present invention provides a low cost, convenient, easily installed mask for temporarily closing the open end of a fixture to prevent overspray of paint or plaster from entering and fouling an inside of the fixture. In particular, the present invention is readily applied to recessed canister-type lighting wherein the canister is held on a backside of the wall or ceiling and an open end of the canister is substantially flush with the wall or ceiling. During spraying of the wall or ceiling, overspray can enter the canister. To prevent the overspray from entering the canister, a spray shield is provided which is uniquely configured to be held within the open end of the canister.

A spray shield is provided which preferably is constructed of cardboard, and preferably is constructed as an integral part of the shelf packaging for the light to be installed.

The shield provides around its outer perimeter a plurality of radial slots which define between slots radially extending tabs. An inside diameter joining a radially inward end of the slots conforms approximately to an inside diameter of the canister to be masked. The inside diameter of the slots can also be slightly larger than the inside diameter of the canister to insure a resilient or compressed fit. In use, the tabs are bent off roughly perpendicular to the surface of the shield to form a shallow pan shape. The tabs retain an outward resiliency which enables the shield, once inserted into the mouth of a fixture, to be grippingly held therein. The disk shaped panel of the shield is thereupon arranged approximately flush with an open end of the fixture and the wall or ceiling to which it is mounted.

The shield, in addition to providing the radial tabs, can provide at least one circular, punch out, finger hole particularly useful in removing the shield from the canister once spraying is complete. As an alternate to one finger hole, two or four fingers holes can be provided.

The shield is advantageously arranged and adapted to be removed from a packaging panel of the fixture as sold. One panel of the package has an outline of the shield marked for scissor cutting or has an outer perimeter of the shield die cut or weakened for the shield to be removed therefrom. Thus, the package, generally discarded after removal of the fixture, serves a second useful function to provide the material for the shield.

The fixture to which the present invention can be applied can be a canister light (either recessed or not), other types of light fixtures, electric junction boxes, or any other type fixture where masking off of an open face is required for spraying operations.

DETAILED DESCRIPTION OF THE PREFERRED EMBODIMENTS

Figure 1:
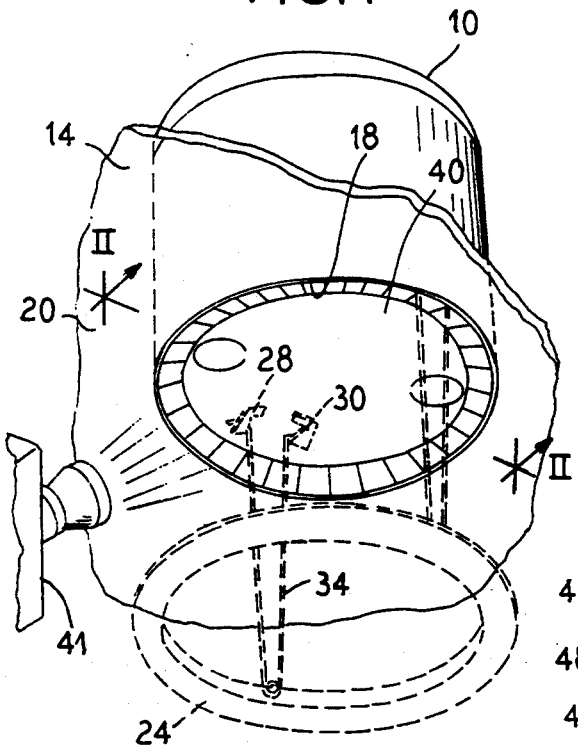
FIG. 1 is a perspective view of the present invention installed into a canister recessed lighting fixture.

FIG. 1 illustrates a canister light 10 mounted recessed with respect to a wall or a ceiling 14 and having an open face 18 mounted substantially flush with a front side 20 of the wall 14. The canister light 10 in finished form includes an annular trim piece 24 suspended from inside hooks 28, 30 via a spring member 34, at two places. Preferably, the trim piece 24 is installed after spraying is completed. However, it is conceivable to install the trim piece before spraying and the trim piece can be pulled down in the position shown in phantom lines in FIG. 1 during painting of the wall or ceiling 14 and then resiliently pushed upwardly to cover the juncture between the canister 10 and the wall 14. Mounted within the open face 18 is a spray shield 40, described in more detail in FIGS. 2–5. The spray shield 40 protects an inside of the canister from spraying during coating of the wall or ceiling 14 by a sprayer 41.

Figure 2:
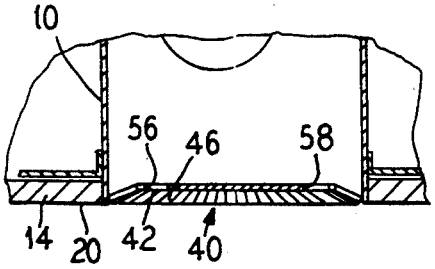
FIG. 2 is a sectional view taken generally along II—II of FIG. 1.
Figure 3:
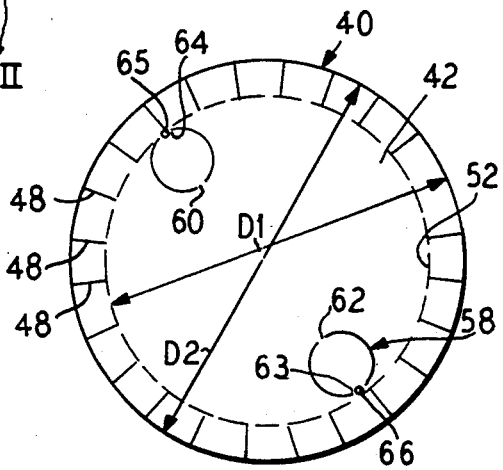
FIG. 3 is a plan view of a spray shield shown in FIG. 1.

FIG. 2 and FIG. 3 illustrate the spray shield 40 comprising a disk portion 42 and surrounding radial tab portions 46. The cumulative surrounding tab portions 46 and the disk portion 42 form a shallow pan configuration. As shown in FIG. 3, the shield 40 provides a plurality of slots or die cuts 48 arranged radially and extending from a first diameter D1 to a second diameter D2. The first diameter D1 is smaller than the diameter of the canister 10. The second diameter D2 is slightly larger than the inside diameter of the canister to insure a compressed insertion. The tabs are formed between slots 48.

Along the circumference defined by the first diameter D1, is a circular fold line 52 which can be facilitated by a weakening of the shield material along this line by creasing, perforating, partially cutting, etc. The disk portion 42 also provides two finger hole panels 56, 58 which can be weakened such as by partially die cutting through the material of the disk portion leaving a hinge portion 60, 62 respectively, and a small uncut portion 63, 64 respectively opposite thereto. A nick or small cut-out 64, 65 can be provided adjacent the uncut portions 63, 64 to facilitate initial punching of the finger hole to be folded about the hinge 60, 62. Alternatively, the panels 56, 58 can be only partially cut through the shield, around their respective circles. The finger holes assist in removing the shield 40 from the fixture or from packagings as explained below with regard to FIG. 5.

Figure 4:
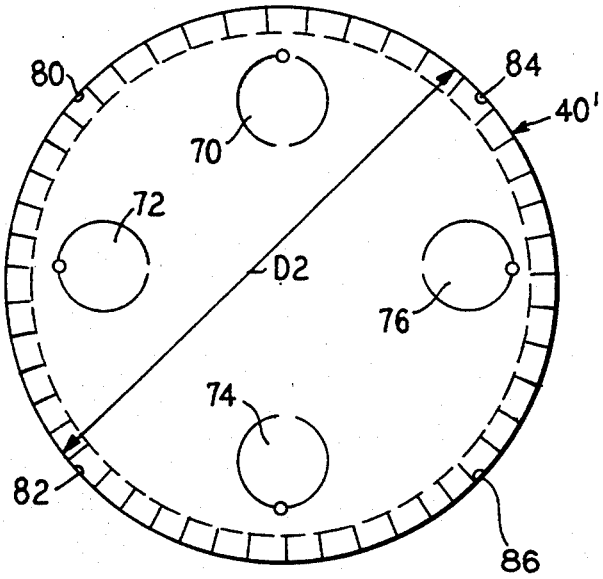
FIG. 4 is an alternate embodiment of a spray shield.

FIG. 4 shows another embodiment of the spray shield 40' having four finger hole panels 70, 72, 74, 76. Additionally, four nicks or cut-outs 80, 82, 84, 86 arranged at quarter points are provided around the outer diameter D2 whose function are better explained with regard to FIG. 5.

Figure 5:
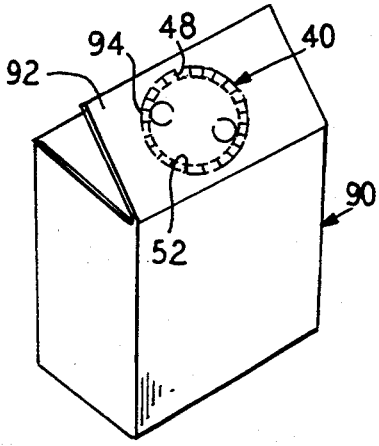
FIG. 5 is a perspective view of a package containing the spray shield of FIG. 3 on a panel thereof.

FIG. 5 shows a box or package 90 for use in packaging a canister light 10 to be sold. As an advantageous application of the invention, the spray shield 40 is formed as an integral portion of a panel 92 of the package 90. Around the outer diameter D2, the panel 92 is at least marked, or advantageously weakened or partially cut, around a circumferential line 94. The slots 48 can be pre-cut or weakened and the circular fold line 52 can be pre-weakened. The alternate spray shield 40' from FIG. 4 can be applied similarly onto the panel 92 of the package 90. In such a case, the nicks 80, 82, 84, 86 provide a weakened spot around the partially cut or weakened outer circumferential line 94 to aid in punching out the spray shield 40' from the panel 92. Once removed from the panel 92, the spray shield 40 or 40' can be installed as shown in FIG. 1. The finger hole panels shown in either FIG. 3 or 4 assist in removing the spray shield from the panel 92 or later from the fixture after spraying.

Although the spray shield is shown as round to fit within a round canister fixture, other shapes such as rectangular are encompassed by the invention. Additionally, the present invention can be applied to any type fixture which has an open face to prevent overspray from entering the fixture, although the application to a light fixture is particularly advantageous.

Although the present invention has been described with reference to a specific embodiment, those of skill in the art will recognize that changes may be made thereto without departing from the scope and spirit of the invention as set forth in the appended claims.

I claim as my invention:

1. A spray shield for covering an open face of an electrical fixture having a surrounding wall, comprising:

a flat panel having a plurality of outwardly extending tabs adapted and arranged to be bent off from said flat panel, said flat panel sized to interfit within said surrounding wall of an electrical fixture, said tabs resiliently pressing against said surrounding wall of said electrical fixture to hold said flat panel in place covering an opening of said electrical fixture, said tabs separated by thin slits to prevent paint from entering therebetween; and a package integral with said flat panel, said package sized and shaped to hold said fixture therein, said flat panel separatable from said package along a pre-weakened interface between said package and said flat panel.

2. A package for holding a building light fixture, comprising:

a plurality of cardboard panels surrounding said light fixture wherein one of said panels comprises a spray shield removable therefrom, said spray shield comprising a panel portion surrounded by radially extending tabs separated by slots, said panel portion sized to interfit within an open face of said light fixture with said tabs resiliently pressing outwardly against said light fixture.

3. The package according to claim 2, wherein said panel portion comprises at least one finger hole.

4. The package according to claim 2, wherein said spray shield is round and an outer circumference of said spray shield forms a circular line interface with said at least one panel, said circular line interface being weakened for easy removal of said spray shield.

5. The combination of a canister light and a spray shield, comprising:

a canister light having a surrounding wall and an open face;

a spray shield having a flat panel and means for attaching said flat panel to said canister light, said flat panel sized to interfit within said surrounding wall of said canister light, said means for attaching for holding said flat panel in place covering said open face of said canister light.

6. The combination according to claim 5, wherein said means for attaching comprises a plurality of outwardly extending tabs from said flat panel adapted and arranged to be bent off from said flat panel to resiliently hold said flat panel against said surrounding walls of said canister light.

7. The combination according to claim 5 further comprising a package integral with said spray shield, said package sized and shaped to hold said canister light therein, said spray shield separable from said package along a pre-weakened interface between said package and said spray shield.

8. A spray shield for covering an open face of a building electrical fixture having a surrounding wall, comprising:

a flat panel having a plurality of outwardly extending tabs adapted and arranged to be bent off from said flat panel, said flat panel sized to interfit within said surrounding wall of an electrical fixture, said tabs resiliently pressing against said surrounding wall of said electrical fixture to hold said flat panel in place covering an opening of said electrical fixture, said tabs separated by thin slits to prevent paint from entering therebetween.

9. The spray shield according to claim 1, wherein said tabs are arranged continuously around an outer perimeter of said flat panel.

10. The spray shield according to claim 1, wherein said flat panel comprises at least one finger hole.

11. The spray shield according to claim 8, wherein said flat panel is round and said tabs extend radially.

12. The spray shield according to claim 8, wherein said flat panel is round and said tabs extend radially, separated by die cutting.

13. The spray shield according to claim 8 wherein said flat panel is round and said tabs are arranged continuously around an outer circumference of said flat panel, said tabs radially extending and separated by slots.

14. The spray shield according to claim 8, wherein said flat panel is round and said tabs are arranged continuously around an outer circumference of said flat panel defining a circular outside diameter sized so said tabs are slightly bent off from said flat panel when installed into said electrical fixture.

15. A spray shield for a canister light, comprising:

a flat disk shaped portion sized to be interfittable within an open face of said canister light; and resilient means outwardly extending from said flat disk shaped portion for pressing against the inside surface of said canister light to hold said flat disk portion across an open face of said canister light, said resilient means continuously surrounding said flat disk-shaped portion said resilient means being planar with said flat disk shaped portion in a relaxed state, and assumes a nonplanar configuration when pressed against the inside surface of said canister light.

16. The spray shield according to claim 15, wherein said flat disk portion provides at least one punch out finger hole.

17. The spray shield according to claim 15, wherein said resilient means comprises a plurality of radially extending tabs extending from said flat disk shaped portion, bendable to facilitate insertion of said flat disk portion into said canister light, said tabs resiliently pressing against an inside of said canister light.

18. The spray shield according to claim 17, wherein said radially extending tabs are separated by radially extending thin slits.

19. The spray shield according to claim 15, wherein said spray shield further comprises a package, said package sized and adapted to hold said canister light therein, said spray shield connected to said package and removable therefrom.

20. The spray shield according to claim 19, wherein said package comprises at least one panel having a hole therethrough having an identical shape as said spray shield, said spray shield connected to said panel covering said hole.

21. The spray shield according to claim 20, wherein said spray shield and said panel are connected along a line of intentional weakness for removal of said spray shield from said panel.

22. The spray shield according to claim 21, wherein said disk shaped portion comprises at least one finger hole.

23. A method for protecting an inside of a canister light from spraying, comprising the steps of:

providing a spray shield sized and shaped to interfit within an open face of said canister light;

providing compression members on a perimeter of said spray shield to press against an inside surface of said canister light once inserted therein; and retaining said spray shield within said open face of said canister light during spraying.

24. The method according to claim 23 comprising the further steps of marking an outline of said spray shield on a panel of packaging of said canister light; and removing said spray shield from said panel at said outline before placing said spray shield into said canister.

25. The method according to claim 24 comprising the further step of weakening said panel along said outline before removal of said spray shield.

* * * * *